US005983520A

United States Patent [19]

Kim et al.

[11] Patent Number: 5,983,520

[45] Date of Patent: Nov. 16, 1999

[54] MICROWAVE DRYER FOR WASHING MACHINE

[75] Inventors: Yang Kyeong Kim, Inchon; Hyoung Joo Kang, Kwangmyung, both of Rep. of Korea

[73] Assignee: LG Electronics Inc., Rep. of Korea

[21] Appl. No.: 09/135,201

[22] Filed: Aug. 17, 1998

[30] Foreign Application Priority Data

Oct. 8, 1997 [KR] Rep. of Korea ..... 97-51645
Jul. 7, 1998 [KR] Rep. of Korea ..... 98-27262

[51] Int. Cl.[6] ..... F26B 3/34

[52] U.S. Cl. ..... 34/261; 34/265

[58] Field of Search ..... 34/265, 260, 261, 34/73, 77, 468

[56] References Cited

U.S. PATENT DOCUMENTS 4,765,066 8/1988 Yoon ..... 34/1
5,146,693 9/1992 Dottor et al. ..... 34/77
5,187,879 2/1993 Holst ..... 34/1 DD
5,463,821 11/1995 Gauer .

*Primary Examiner*—Henry Bennett
*Assistant Examiner*—Malik N. Drake
*Attorney, Agent, or Firm*—Ostrolenk, Faber, Gerb & Soffen, LLP

[57] ABSTRACT

A microwave dryer for a washing machine is disclosed. The dryer includes an outer tub installed within a main body; a washing tub installed inside the outer tub and being rotatable during a washing and drying mode for laundry; a driving shaft passing through the center portions of the outer tub and the washing tub, receiving a driving force from a driving transfer means and rotating the washing tub; a microwave generator means installed at a rear center portion of a support bracket fixed to the outer tub for generating microwaves for drying laundry; a microwave spreading means for spreading the microwaves into the interior of the washing tub; a microwave shielding means for preventing the microwaves from being leaked to the portions surrounding the driving shaft; and a circulation means for condensing a high temperature and humid air mixed with microwaves by supplying dry air into the interior of the washing tub during the drying operation of the laundry and discharging the thusly condensed vapor to the outside of the main body.

9 Claims, 6 Drawing Sheets

MICROWAVE DRYER FOR WASHING MACHINE

BACKGROUND OF THE INVENTION

1. Field of the Invention

The present invention relates to a microwave dryer for a washing machine, and in particular to an improved microwave dryer for a washing machine which is capable of implementing a washing and drying operation in a washing tub of a microwave dryer using microwaves.

2. Description of the Conventional Art

Generally, when a washing and drying operation for laundry is finished, a user operates a dryer operation key for a drying operation for the laundry. FIG. 1 illustrates a conventional heating type dryer for a washing machine. As shown therein, as a fan motor 19*a* installed at an upper portion of a main body 1*a* for drying laundry in a washing tub 4*a* of the main body 1*a* is operated, air is flown into the interior of the washing tub 4*a* through a dryer duct 18*a*. At this time, the air flown thereinto is heated by a heater 26 installed at an upper portion of the dryer duct 18*a* and the heated dry air is flown into the interior of the washing tub 4*a*. Here, the high temperature air serves to evaporate moisture of the laundry in the washing tub 4*b* for thereby dehydrating the laundry.

In addition, since the heated air is continuously provided thereinto by the fan motor 19*a*, moisture is evaporated from the laundry in the washing tub 4*b*, and the air containing moisture is flown to a condensing duct 23*a*. In the condensing duct 23*a*, moisture contained in air is condensed for thereby forming water. The thusly formed water is discharged to the outside of the main body 1*a* through a drainage hose 27. The dehydrated air is heated again by the heater 26 and is transferred into the interior of the washing tub 4*a* through the dryer duct 18*a*. The above-described operations are continuously repeated for thereby fully evaporating moisture of the laundry.

In addition, the method and apparatus for operating a microwave dryer disclosed in U.S. patent Ser. No. 5,463,821 is capable of more quickly drying the laundry compared to the heating type dryer and preventing any damage of the laundry. When the washing operation is finished, the laundry is dehydrated using microwaves generated by a magnetron. The above-described apparatus will be explained in more detail with reference to FIGS. 2 through 4.

As shown therein, laundry is inputted into a drying chamber (not shown) installed in the interior of a drum 28 of the main body 1*b* by opening a door 2*a* installed in the front portion of the main body 1*b*, and then a drying operation key is operated, so that the drying operation for the laundry is started.

Therefore, microwaves generated by the magnetron 30 installed in the interior of baffles 29 formed on the inner circumferential surface of the drum 28 pass through a plurality of through holes 29*a* formed in the baffles 29 for thereby drying the laundry in the drying chamber of the drum 28. At this time, a plurality of holes are formed on the lateral walls of the drum 28, so that air is flown into the drying chamber of the drum 28 therethrough, and the thusly flown air servers to cool the magnetron 30 installed in the interior of the baffles 29. In addition, a power line 31 is installed on a lateral wall of the drum 28 for continuously supplying an electric power even when the drum 28 is rotated during the drying operation. The drum 28 is rotated by the motor 32 installed below the main body 1*b*, and the microwaves generated by the magnetron 30 pass through the holes 29*a* formed in the baffles 29 for thereby dehydrating the laundry in the drum 28. The air flown into the drying chamber through the holes formed on the lateral walls of the drum 28 contain much moisture, and then are discharged to the outside of the main body 1*b* through the holes 33 formed at the rear center portion of the drum 28. The above-described operations are repeated.

However, in the conventional heating type dryer for a washing machine, air is heated by the heater 26, and the thusly heated air servers to evaporate moisture contained in the laundry. Namely, the conventional heating type dryer is directed to an indirect heating method. In this case, much heat exchanging loss occurs during the washing and drying operations, so that the drying efficiency is decreased, and the drying time is extended. In order to effectively evaporate moisture from the creased portions of the laundry, the surface temperature of the laundry should be increased for thereby damaging the laundry.

In addition, in the conventional microwave dryer for a washing machine, the magnetron 30 is directly disposed in the interior of the baffles 29 of the inner circumferential surface of the drum 28. As the drum 28 is rotated, the magnetron 30 emits microwaves. The electric power of over 4000 Volts supplied to the magnetron 30 in the direct contact method may make fire due to spark. In addition, since a leakage between the drum 28 and the magnetron 30 and a high speed rotation are not implemented, it is impossible to effectively implement a washing and drying function. After the washing operation of the laundry is finished, the laundry is manually moved into the drying chamber of the dryer for thereby causing much inconvenience.

SUMMARY OF THE INVENTION

Accordingly, it is an object of the present invention to provide a microwave dryer for a washing machine which overcomes the aforementioned problems encountered in the conventional art.

It is another object of the present invention to provide a microwave dryer for a washing machine which is capable of implementing a washing and drying operation in a washing tub of a microwave dryer for a washing machine and preventing any damage of laundry.

To achieve the above objects, there is provided a microwave dryer for a washing machine which includes an outer tub installed within a main body; a washing tub installed inside the outer tub and being rotatable during a washing and drying mode for laundry; a driving shaft passing through the center portions of the outer tub and the washing tub, receiving a driving force from a driving transfer means and rotating the washing tub; a microwave generator means installed at a rear center portion of a support bracket fixed to the outer tub for generating microwaves for drying laundry; a microwave spreading means for spreading the microwaves into the interior of the washing tub; a microwave shielding means for preventing the microwaves from being leaked to the portions surrounding the driving shaft; and a circulation means for condensing a high temperature and humid air mixed with microwaves by supplying dry air into the interior of the washing tub during the drying operation of the laundry and discharging the thusly condensed vapor to the outside of the main body.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
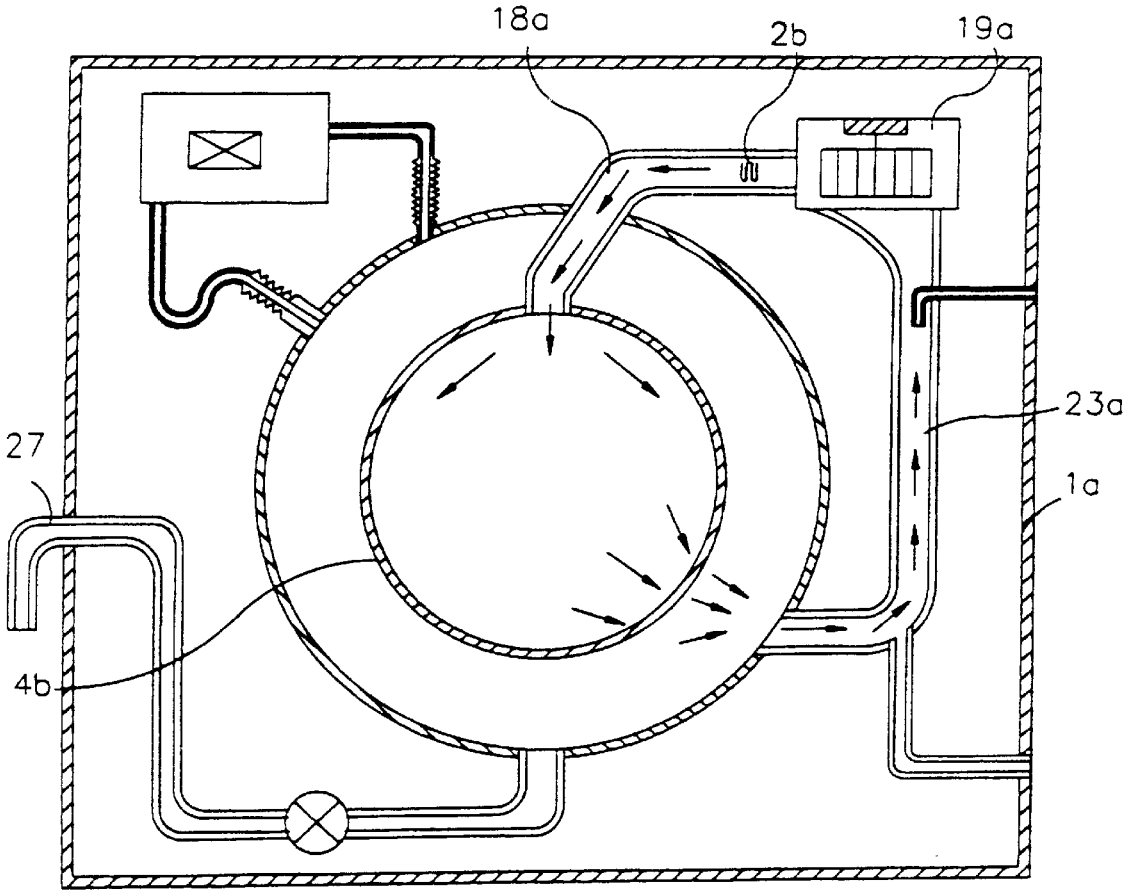
FIG. 1 BACKGROUND ART
FIG. 1 is a cross-sectional view illustrating a conventional heating type dryer for a washing machine.
Figure 2:
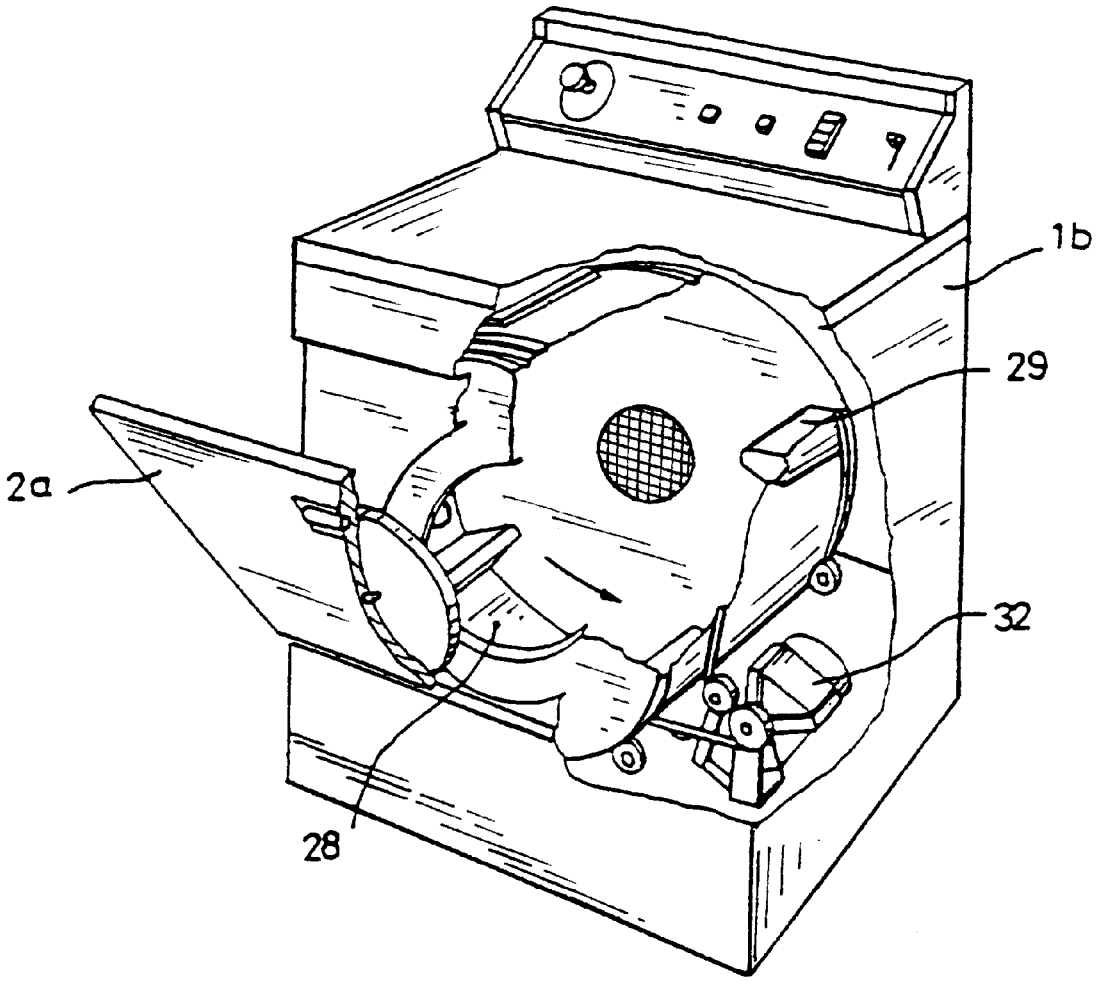
FIG.2 BACKGROUND ART
FIG. 2 is a partially cut-away perspective view illustrating a conventional microwave dryer for a washing machine.
Figure 3:
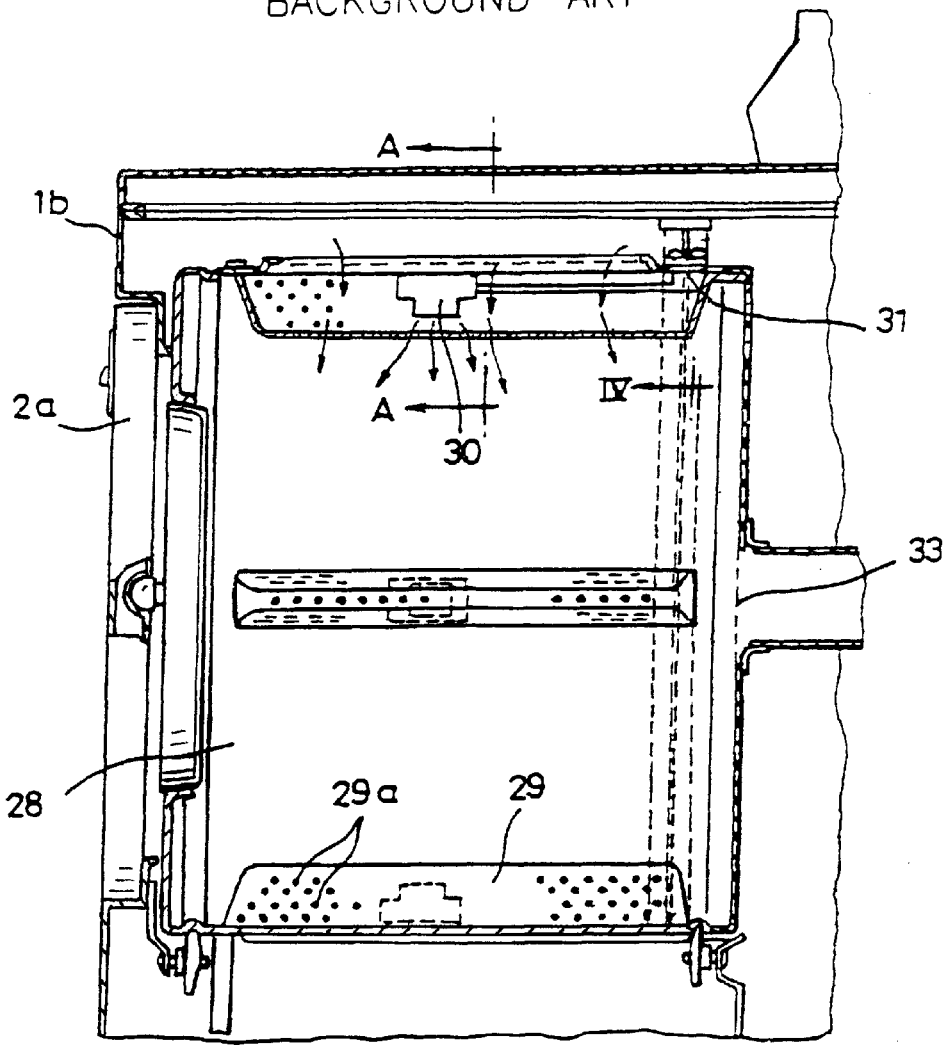
FIG. 3 BACKGROUND ART
FIG. 3 is a cross-sectional view illustrating the microwave dryer of FIG. 2.
Figure 4:
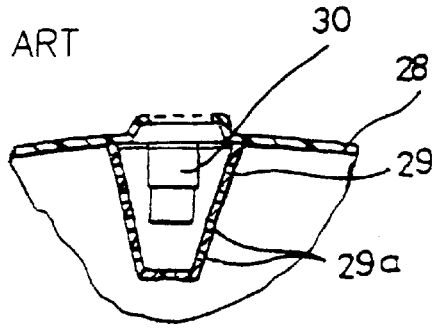
FIG. 4 BACKGROUND ART
FIG. 4 is a cross-sectional view taken along line A—A of FIG. 3.
Figure 5:
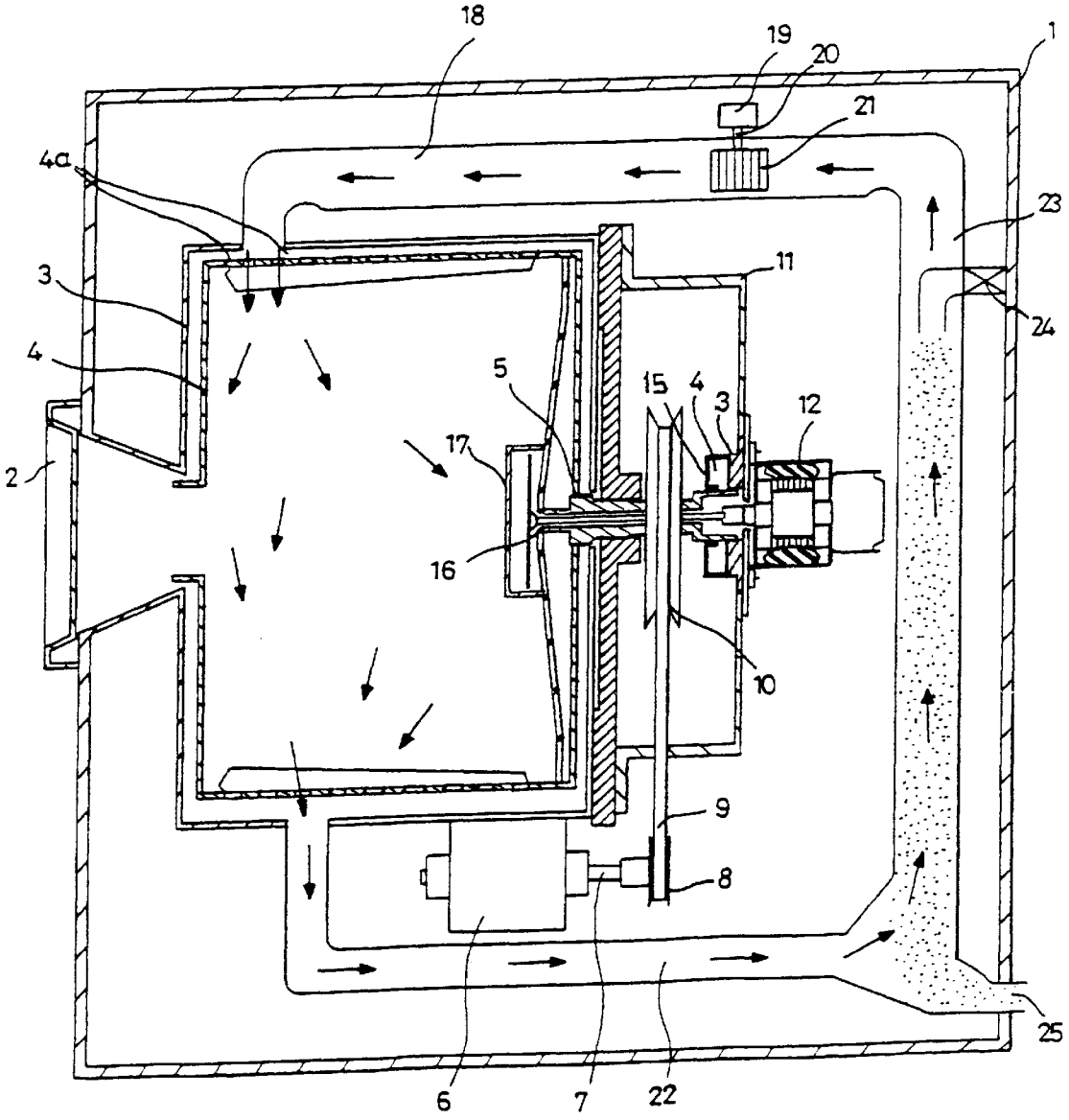
FIG. 5 is a cross-sectional view illustrating a microwave dryer for a washing machine according to the present invention.
Figure 6:
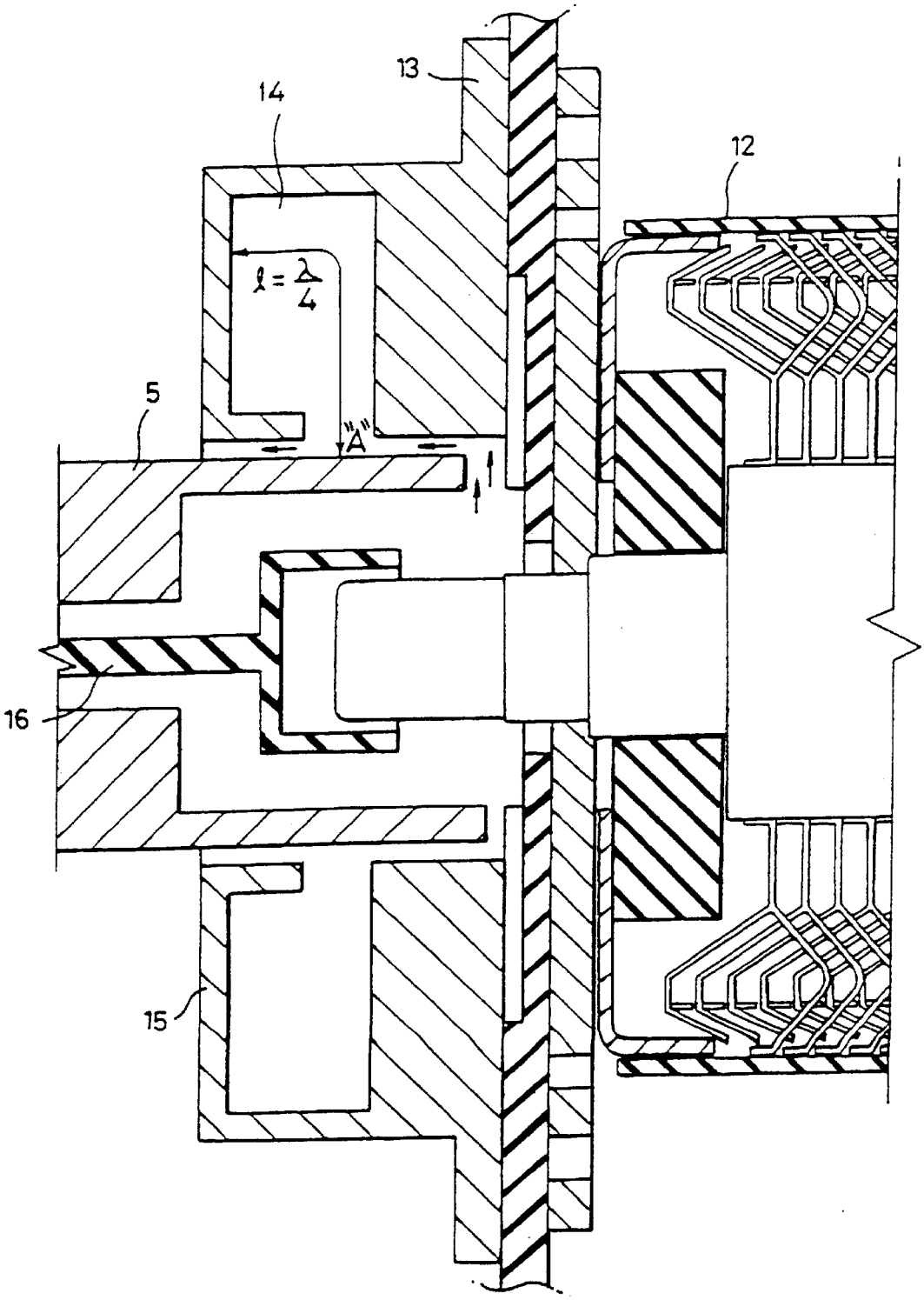
FIG. 6 is a cross-sectional view illustrating a choke unit of FIG. 5.
Figure 7:
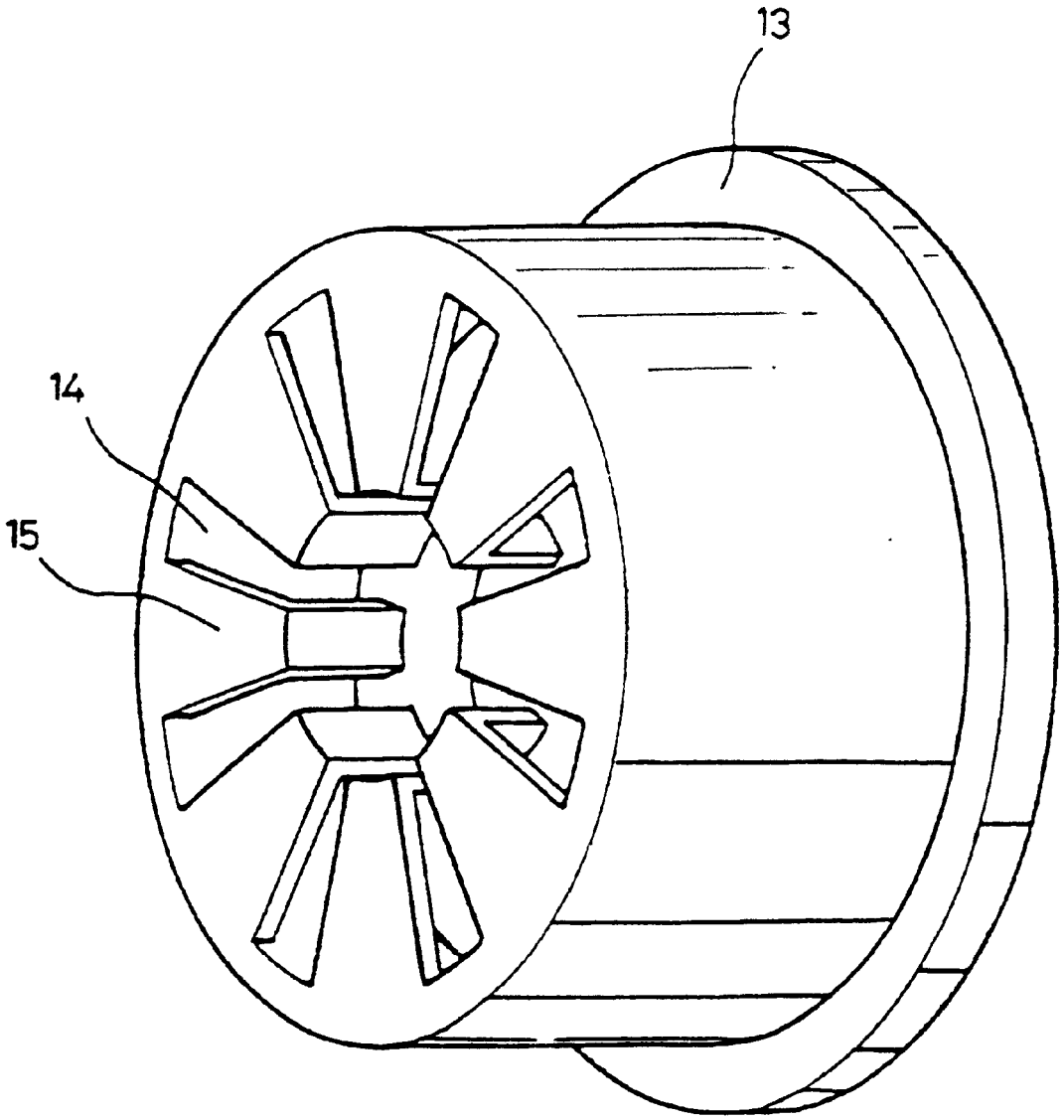
FIG. 7 is a perspective view illustrating the choke unit of FIG. 5.

As shown in FIGS. 5 through 7, in the microwave dryer for a washing machine, a door 2 is disposed on a front surface of a main body 1. An outer tub 3 is installed in the interior of the main body 1. A rotatable washing tub 4 having a plurality of holes 4*a* and rotating during a washing and drying operation is installed outside the outer tub 3. A hollow driving shaft 5 is extended downwardly, passes through the outer tub 3 and the washing tub 4, and servers to rotate the washing tub 4.

In addition, a motor 6 is installed below the outer tub 3 for rotating the washing tub 4 during a washing and drying operation. A driving pulley 8 is drivingly connected with a motor shaft 7 of the motor 6 for receiving a driving force generated by the motor 6. A driven pulley 10 is installed in the driving shaft 5 for receiving a rotational force of the driving pulley 8 through a belt 9 for driving the driving shaft 5.

A support bracket 11 is installed below the outer tub 3, and a magnetron 12 is installed at the outer center bottom portion of the support bracket 11 for generating microwaves. A choke body 13 is fixed to an inner center bottom portion of the support bracket 11 for covering the driving shaft 5 for preventing any leakage of microwaves generated by the magnetron 12. A plurality of choke seals 15 each having a choke room 14 are formed in the choke body 13, and a predetermined position A of the entrance portion of each choke room 14 is formed at a predetermined distance of $\lambda/4$ (/) from the inner surface of each choke seal 15.

An antenna 16 having its one end connected with the magnetron 12 for supplying microwaves generated by the magnetron 12 into the interior of the washing tub 4 is inserted into the hollow portion of the driving shaft 5, and a protection cap 17 is fixed to the rear center portion of the washing tub 4 for protecting the antenna 16.

In addition, a dryer duct 18 communicates with the upper portion of the outer tub 3 for supplying air into the interior of the washing tub 4 during a drying operation. A fan motor 19 is installed at an upper portion of the dryer duct 18 for supplying air into the interior of the washing tub 4 through the dryer duct 18, and a blowing fan 21 which is operated by the rotational force transferred through the motor shaft 20 within the dryer duct 18 is installed in the motor shaft 20 of the fan motor 19.

A discharge duct 22 is installed below the outer tub 3 for discharging high temperature and humid air in the interior of the washing tub 4 during a washing operation. A condensation duct 23 is installed between the dryer duct 18 and the discharge duct 22 for guiding the flow of high temperature and humid air discharged through the discharge duct 22, and a condenser water supply valve 24 is installed at an upper portion of the condensation duct 23 for supplying water when condensing high temperature and humid air, and a discharge port 25 is installed below the condensation duct 23 for discharging the condensed water to the outside of the main body 1.

The operation of the thusly constituted microwave dryer for a washing machine according to the present invention will be explained with reference to FIGS. 5 through 7. First, a user inserts some laundry into the interior of the washing tub 4 and then selects the automatic washing mode. Thereafter, the washing, rinsing, dehydrating and drying operations are sequentially performed.

In more detail, when a user inserts some laundry into the interior of the washing tub 4 and selects the automatic washing mode, washing water is filled into the washing tub 4 to a predetermined level in accordance with a control signal from a controller (not shown). As the motor 6 installed below the outer tub 3 is driven, the driving pulley 8 connected with the motor shaft 7 of the motor 6 receives a driving force generated by the motor 6 through the motor shaft 7. The driven pulley 10 installed in the driving shaft 5 passing through the outer tub 3 and the washing tub 4 is rotated by receiving the rotational force of the driving pulley 8 through the belt 9.

As the driving shaft 5 is rotated, since the washing tub 4 connected with the driving shaft 5 is rotated in the outer tub 3 together with the driving shaft 5, the laundry in the washing tub 4 is flown together with the washing water, and the washing operation is performed with a predetermined friction between the laundry and the inner wall of the washing tub 4 and the detergent dissolved into the washing water. When the washing operation is completed, the rinsing and dehydrating operations are performed, so that the entire washing operation is completed.

When the washing operation is completed, since the washing tub 4 is continuously rotated by the motor installed below the outer tub 3, and the water after washing laundry is flown in the washing tub 4. At this time, as the magnetron installed by the support bracket 11 fixed to an end extended from the driving shaft 5 is operated, microwaves are generated. The thusly generated microwaves are guided by the antenna 16 connected with the magnetron 12, one end of the antenna 16 being inserted into the hollow portion of the driving shaft 5. Therefore, the thusly generated microwaves are supplied into the interior of the washing tub 4 through the hollow portion of the driving shaft 5.

As the fan motor 19 communicating with the upper portion of the outer tub 3 and disposed at an upper portion of the dryer duct 18 through which air is supplied into the interior of the washing tub 4 is driven, the blowing fan 21 disposed in the motor shaft 20 of the fan motor 19 is rotated within the dryer duct 18, the dry air is supplied into the washing tub 4 through the dryer duct 18.

Therefore, microwaves emitted into the interior of the washing tub 4 circulate within the interior of the washing tub 4 together with the dry air supplied into the interior of the washing tub 4 through the dryer duct 18 and penetrate into the laundry, so that the moisture contained in the laundry is quickly heated and then evaporated. The thusly evaporated moisture contained in humid air is upwardly flown to the condensation duct 23 communicating between the dryer duct 18 and the discharge duct 22 disposed below the outer tub 3.

At this time, water is supplied from the condensation water supply valve 24 installed above the condensation duct 23 for condensing the high temperature and humid air for thereby preventing the high temperature and humid air from being upwardly flowed through the condensation duct 23 and being introduced again into the interior of the washing tub 4 through the dryer duct 18, whereby the high temperature and humid air is condensed to water and then the thusly condensed water is discharged to the outside of the main body 1 through the discharge port 25.

Thereafter, the condensed and dry air are supplied into the interior of the washing tub 4 through the dryer duct 18 by the blowing fan 21 and the fan motor 19. The above-described operations are repeatedly performed, so that it is possible to effectively dry the laundry in the washing tub 4.

When the laundry in the washing tub 4 is dried by the microwaves emitted from the magnetron 12, the microwaves may leak through a gap between the hollow portion of the driving shaft 5 and the magnetron 12 because the driving shaft 5 is rotated, and the magnetron 12 is fixed to the support bracket 11 installed behind the outer tub 3. The microwaves may be continuously leaked through the gap between the driving shaft 5 and the choke body 13 because the microwaves are sealed by the driving shaft 5 and the choke body 13. Therefore, it is needed to prevent the leakage of the microwaves.

In the present invention, in order to prevent the leakage of the microwaves, there are provided a plurality of choke seals formed in the choke body 13 fixed to surround the driving shaft 5 and each having a choke room 14 for preventing any leakage of the microwaves emitted from the magnetron 12. The point "A" of the entrance of each choke room 14 is formed at a $\lambda/4$ distance from the inner surface of each choke seal 15. Therefore, the impedance at the point "A" of the entrance of each choke seal 15 has unlimited value, so that the microwaves are not leaked to the outside.

At this time, the choke seals 15 have the choke rooms 14 in the choke body 13 for effectively preventing the leakage of the microwaves having various incident angles.

Namely, in the present invention, the principle of the choke system for preventing leakage of the microwaves is implemented by increasing the impedance at the point "A" of the entrance of the choke room 14. The impedance on a transmission line will be explained with reference to the following equation.

The input impedance at the point spaced away by/from a load is expressed as follows:

$$Zin = Zo - \frac{Ze + jZo\tan\beta l}{Zo + jZe\tan\beta l} \quad \text{[Equation 1]}$$

where Zo represents a characteristic impedance, and Zo and $\beta$ represent values determined based on the structure of a transmission path and a dielectric rate.

Therefore, since the choke seals 15 formed in the choke body 13 are short, Ze=0 is implemented, and the point is spaced apart by /=$\lambda$4 ($\lambda$ represents a wavelength of microwave) from each of the inner surfaces of the choke seals 15. The impedance at the above point has a unlimited value.

As described above, in the present invention, it is possible to perform a washing and drying operation using microwaves as a drying source, so that it is not needed to separately use the washing machine and the dryer. After the washing operation is completed, a user can wash and dry the laundry without moving the washed laundry from the washing machine to the dryer for drying the washed laundry for thereby preventing any damages of the laundry. In addition, the choke system is adapted so that any leakage of the microwaves is effectively prevented for thereby enhancing the efficiency and reliability of the product.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A microwave dryer for a washing machine, comprising:

an outer tub installed within a main body;

a washing tub installed inside the outer tub and being rotatable during a washing and drying mode for laundry;

a driving shaft passing through the center portions of the outer tub and the washing tub, receiving a driving force from a driving transfer means and rotating the washing tub;

a microwave generator means installed at a rear center portion of a support bracket fixed to the outer tub for generating microwaves for drying laundry;

a microwave spreading means for spreading the microwaves into the interior of the washing tub;

a microwave shielding means for preventing the microwaves from being leaked to the portions surrounding the driving shaft; and a circulation means for condensing a high temperature and humid air mixed with microwaves by supplying dry air into the interior of the washing tub during the drying operation of the laundry and discharging the thusly condensed vapor to the outside of the main body.

2. The dryer of claim 1, wherein said driving force transfer means includes:

a motor disposed at a lower portion of the outer tub for generating a driving force for rotating the washing tub during the washing and drying operation;

a driving pulley engaged with a motor shaft of the motor for receiving a driving force generated by the motor through the motor shaft and then being rotated; and a driven pulley disposed at the driving shaft for receiving a rotational force of the driving pulley through a belt and rotating the driving shaft.

3. The dryer of claim 1, wherein said microwave spreading means is an antenna having its one end extended to the magnetron for supplying the microwaves generated by the magnetron, the microwave generator means, in the hollow portion of the driving shaft into the interior of the washing tub.

4. The dryer of claim 1, wherein a protection cap is disposed at a rear center portion of the washing tub for protecting the microwave spreading means.

5. The dryer of claim 1, wherein said microwave shielding means includes:

a choke body fixed to the inner surface of the support bracket to surround the driving shaft for thereby forming a predetermined gap with the driving shaft and preventing leakage of the microwaves generated by the magnetron; and a plurality of choke seals inwardly extended from the choke body and each having a choke room.

6. The dryer of claim 5, wherein said choke body includes a plurality of choke seals each having a choke room.

7. The dryer of claim 6, wherein a predetermined point of an entrance portion of each choke room is positioned at a distance of $\lambda/4$ from the inner surface of each choke seal.

8. The dryer of claim 1, wherein said circulation means includes:

a dryer duct communicating with the upper portion of the outer tub for supplying air into the interior of the washing tub during the drying operation of laundry;

a fan motor disposed at an upper portion of the dryer duct and driven for supplying air into the interior of the washing tub through the dryer duct;

a discharge duct communicating with the lower portion of the outer tub for discharging a high temperature and humid air from the washing tub during the drying operation of laundry;

a condensing duct disposed between the dryer duct and the discharge duct for guiding the flow of the high temperature and humid air discharged through the discharge duct; and a discharging port communicating with the lower portion of the condensing duct for discharging the condensed water to the outside of the main body.

9. The dryer of claim 8, wherein a condensation water supply valve is installed at an upper portion of the condensing duct for supplying water when a high temperature and humid air is condensed.

* * * * *